US005421421A

United States Patent [19]

Appleton

[11] Patent Number: 5,421,421

[45] Date of Patent: Jun. 6, 1995

[54] APPARATUS FOR DIRECTIONAL DRILLING

[76] Inventor: Robert P. Appleton, Glenburn House, Tornaveen, Torphins, Aberdeenshire, AB31 4NY, Scotland, United Kingdom

[21] Appl. No.: 64,105

[22] PCT Filed: Nov. 18, 1991

[86] PCT No.: PCT/GB91/02031

§ 371 Date: May 21, 1993

§ 102(e) Date: May 21, 1993

[87] PCT Pub. No.: WO92/09783

PCT Pub. Date: Jun. 11, 1992

[30] Foreign Application Priority Data

Nov. 22, 1990 [GB] United Kingdom ..... 9025444

[51] Int. Cl.[6] ..... E21B 7/06

[52] U.S. Cl. ..... 175/76

[58] Field of Search ..... 166/117.6; 175/73, 74, 175/75, 76

[56] References Cited

U.S. PATENT DOCUMENTS

| | | | |
|---|---|---|---|
| 3,595,326 | 7/1971 | Claycomb | 175/73 |
| 4,305,474 | 12/1981 | Farris et al. | 175/73 |
| 4,471,843 | 9/1984 | Jones, Jr. et al. | 175/73 |
| 4,947,944 | 8/1990 | Coltman et al. | 175/73 |
| 5,181,576 | 1/1993 | Askew et al. | 175/76 X |
| 5,186,264 | 2/1993 | du Chaffaut | 175/76 X |

*Primary Examiner*—Ramon S. Britts
*Assistant Examiner*—Frank S. Tsay

[57] ABSTRACT

A downhole steering tool comprises a hollow mandrel (11), an independently rotatable sleeve (12) extending over a portion of the mandrel (11), steering plungers (26) carried by the sleeve (12) and extendable and retractable laterally to and from pressure contact with the hole wall (28) for steering a drill below the tool when in use, releasable locking means (14) for locking the sleeve (12) to the mandrel (11) rotationally, and fluid control means (15) operable to direct to the locking means (14) and the steering plungers (26) a portion from fluid circulation through the mandrel (11) to release the locking means (14) and to extend the steering plungers (26) by means of pressure of the fluid.

9 Claims, 4 Drawing Sheets

APPARATUS FOR DIRECTIONAL DRILLING

FIELD OF THE INVENTION

This invention relates to apparatus for directional drilling.

BACKGROUND OF THE INVENTION

Directional drilling tools proposed hitherto have a sleeve member disposed on the drillstring adjacent the drillbit and provided with laterally extendable and retractable steering elements operable selectively by means of pressure of the drilling mud to press on the hole wall or borehole and so steer the drillbit. Typical of such tools are those described in, for example, U.S. Pat. Nos. 2,316,409 (Downing) and 3,595,326 (Claycomb); and French Patent Publication 2622920 (SMF International). One disadvantage of these previously proposed tools is that they have not been immediately responsive to actioning of the steering elements due to a delay while these elements move across the well annulus. An associated disadvantage is that a significant portion of the available range of steering element movement, ie. the cross-annulus movement, is not useful for steering.

An object of the present invention is to provide apparatus for directional drilling whereby the mentioned disadvantages may be obviated or mitigated.

SUMMARY OF THE INVENTION

According to the present invention, there is provided apparatus for directional drilling comprising:

- a mandrel for running in a drillstring and defining a longitudinal mandrel axis;
- drillbit means in driving connection with one end of the mandrel for forming a borehole co-axial with the mandrel;
- means defining a supply duct extending longitudinally through the mandrel for carrying drilling fluid to the drill bit means;
- a sleeve extending over the mandrel and having mutually opposite sleeve end portions journalled on the mandrel to permit independence of rotation between the mandrel and the sleeve about said mandrel axis;
- releasable locking means for locking the sleeve to the mandrel rotationally;
- release means associated with the releasable locking means and operative in response to the action of fluid under pressure;
- a portion of said sleeve intermediate said sleeve end portions defining a tubular wall having a longitudinal axis which extends parallel with and offset from said mandrel axis;
- steering means carried by said tubular wall and extendable and retractable laterally thereof with respect to the mandrel axis to and from pressure contact with the intended borehole in response to action of fluid under pressure for steering said drillbit means when in use;
- the steering means being disposed in said tubular wall as viewed in cross-section in that quadrant thereof most distant from the mandrel axis;
- means providing fluid communication between said supply duct and said release means and between said supply duct and said steering means; and
- fluid control means associated with said fluid communication means for diverting drilling fluid from said supply duct to operate the release means and the steering means.

By virtue of the lateral offset of the tubular wall, the steering means can be arranged closer to the hole wall and without seriously obstructing the annulus. Thus, the distance between the hole wall and the steering means can be reduced thereby to obviate or mitigate the aforementioned disadvantages.

DESCRIPTION OF THE PREFERRED EMBODIMENT

Figure 1:
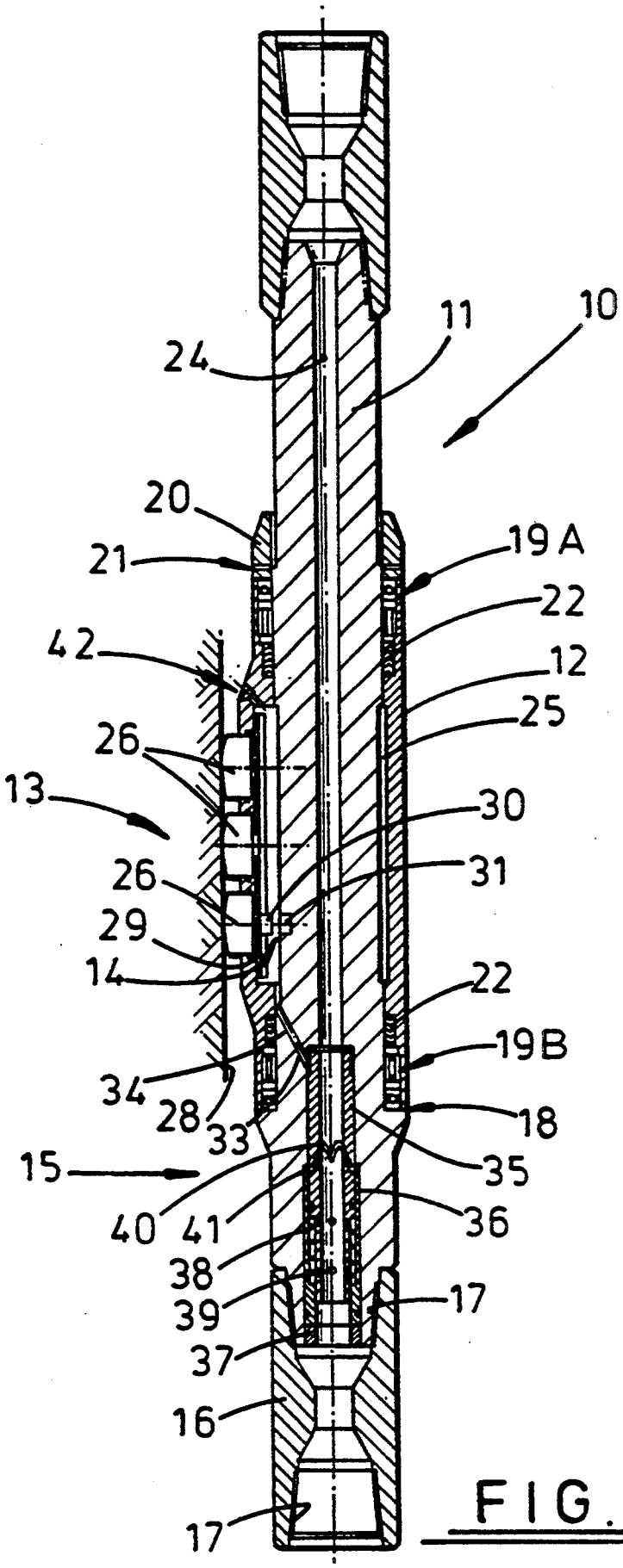
FIG. 1 is a sectional elevation of a downhole tool in accordance with the present invention and showing steering means in an extended condition.

In the drawings, the downhole tool is indicated generally by reference numeral 10 and consists of a hollow mandrel 11 for running in a drillstring (not shown), a sleeve 12 extending over a portion of the mandrel 11 the sleeve and the mandrel being mutually independently rotatable, steering means 13 carried by the sleeve 12 and extendable and retractable laterally thereof, releasable locking means 14 for locking the sleeve 12 to the mandrel 11 rotationally, and fluid control means 15.

More particularly, the mandrel 11 consists of a tubular shaft which defines a supply duct for carrying drilling fluid. A lower end portion of the mandrel 11 is machined to accommodate the fluid control means 15 and also to carry and drive a drillbit (not shown) by means of an adaptor 16 which is provided with standard tapered screw-threaded sockets 17. The mandrel 11 also defines a shoulder 18 for the location of the lowermost of two bearing sets 19A and 19B. Each bearing set 19A, 19B is housed in a respective end portion of the sleeve 12 and includes separate bearings for radial and axial loads. The sleeve 12 complete with its bearings 19A, 19B is retained on the mandrel 11 by means of a screw-threaded collar 20 the screw-threads of which are handed so that during drilling operations the rotation of the tool will tend to urge the collar 20 towards the sleeve 12. The setting of the collar 20 is secured by means of radial lock pins 21.

Within the sleeve 12 and in-board of the bearings 19A, 19B, fluid-pressure-tight seals 22 are provided, oriented to resist passage: of high pressure fluid in a direction towards the respective bearings.

Figure 4:
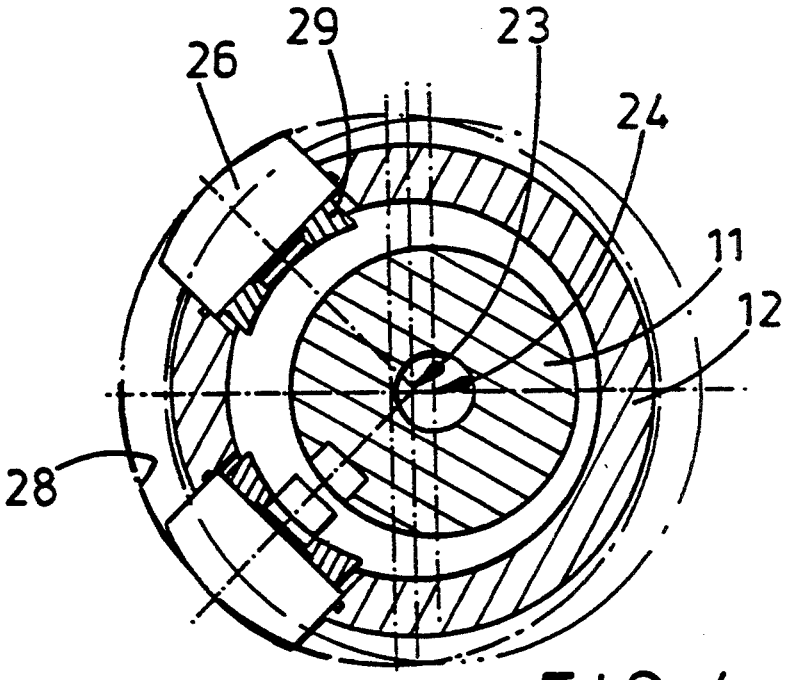
FIG. 4 is a cross-section similar to FIG. 3, but showing steering means in an extended condition.
Figure 3:
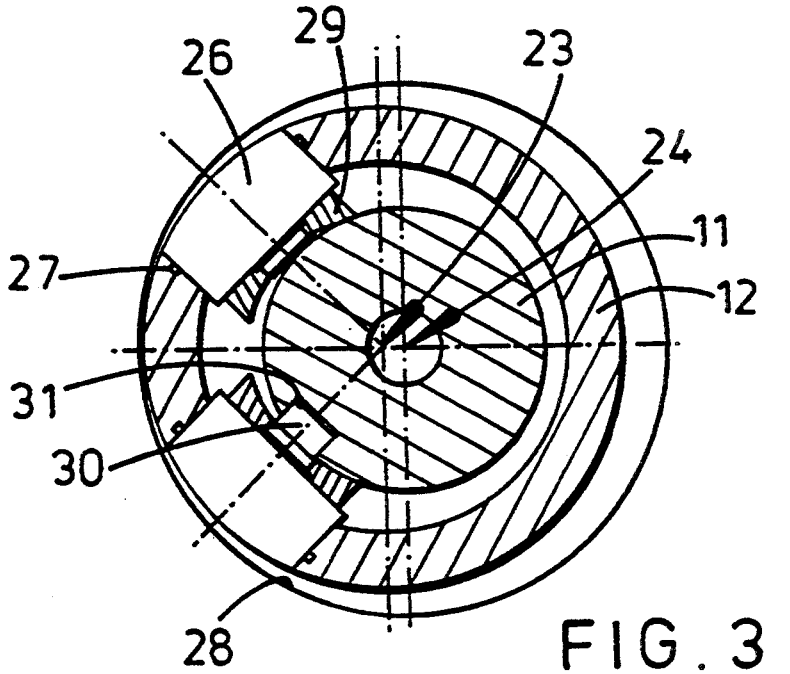
FIG. 3 is a cross-section on the line III—III in FIG. 2.

The wall portion of the sleeve 12 between the upper and lower seals 22 defines a tubular wall of hollow cylindrical configuration of which the axis 23 (see FIGS. 3 and 4) is parallel with and laterally offset from the axis 24 of the mandrel 11. Thus, the sleeve 12 encloses an annular chamber 25 around the mandrel 11; and the said wall portion of the sleeve 12 is eccentric to the rotational axis 24 of the mandrel 11.

Figure 2:
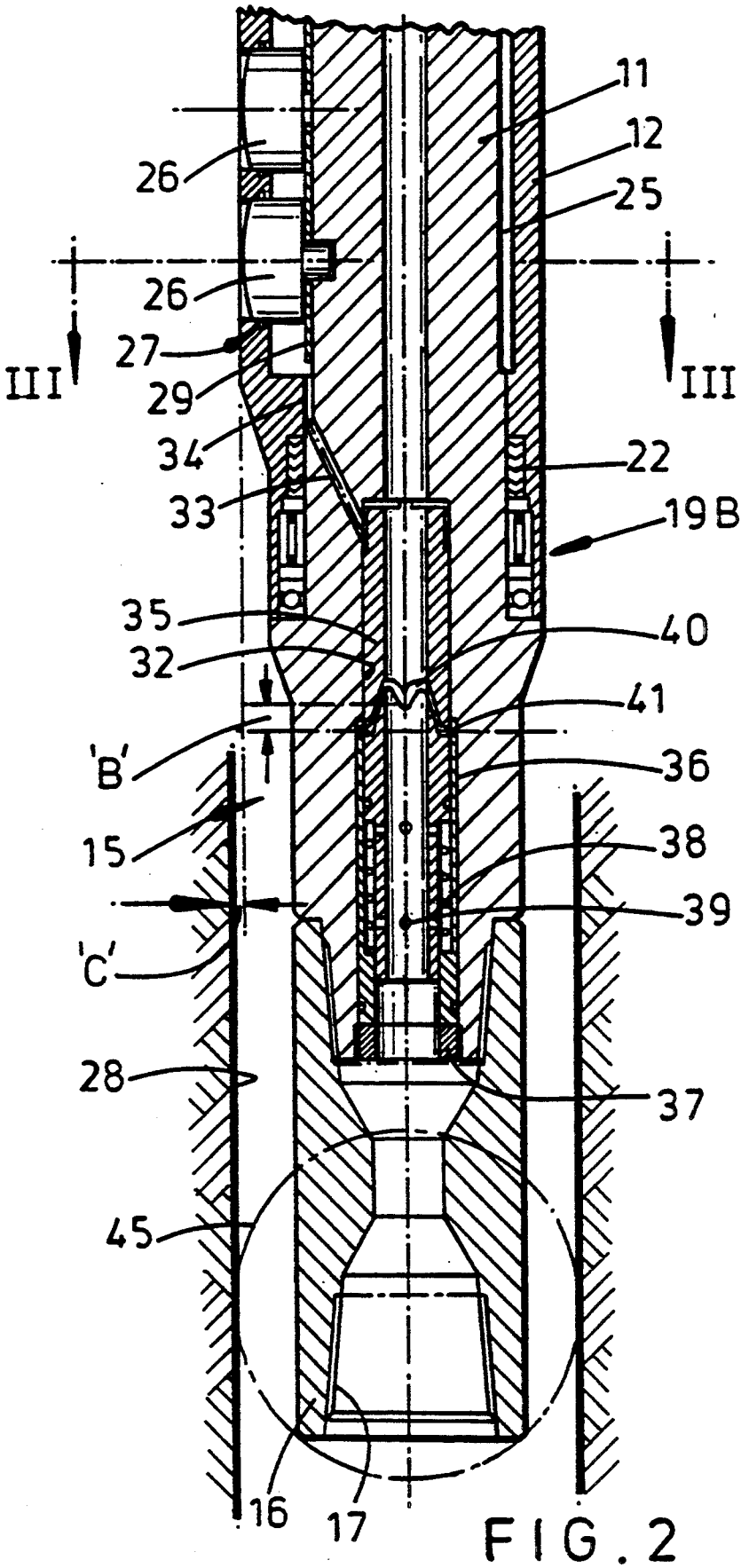
FIG. 2 is a sectional elevation corresponding with part of FIG. 1, but to a larger scale, and showing steering means in a retracted condition.

The steering means 13 consists of a group of plungers 26 which are slidably received in respective openings through the sleeve 12. The plungers 26 engage hydraulic seals 27 carried by the sleeve 12 and are disposed generally in that quadrant of the sleeve 12 which is most distant from the centre of the mandrel 11. The plungers 26 may be retracted as shown in FIG. 2 and extended as shown in FIG. 1 so as to make pressure contact with the hole wall 28 for effecting steering as further described herebelow. The group of plungers 26 is formed by two angularly-spaced rows of three plungers as can be seen from reference to FIGS. 1 and 3. In each row of three plungers 26, the three plungers are mutually interconnected within the annular chamber 25 by means of a retaining strip 29 to which each of the three plungers 26 is secured by welding or other means. More generally, the plungers 26 are grouped together within half of the circumferential dimension of the sleeve 12.

It will be understood that the plungers 26 are extended by means of fluid pressure acting within the annular chamber 25; and the plungers are self-retracting by reaction against the hole wall 28 simply upon removal of fluid pressure within the annular chamber 25.

The releasable locking means 14 consists of mutually engageable locking elements 30 and 31 respectively in the form of a pin 30 formed on one of the plungers 26 and a socket 31 for receiving the pin 30 when the plungers 26 are in retracted condition. Two or more sets of these locking elements may be provided; but the positioning of the locking elements will be such that the sleeve 12 can be locked to the mandrel 11 at only one angular position.

The fluid control means 15 is located within an enlarged bore 32 which extends axially inwards from the lower end of the mandrel 11. Duct means in the form of a drilled duct 33 through the wall of the mandrel 11 and an axially-extending slot 34 milled in the mandrel 11 provides fluid communication between the interior of the mandrel, which is the supply duct for drilling fluid, and the annular chamber 25. The inner end of the drilled duct 33 emerges into the enlarged bore 32 just below the upper end thereof and is normally closed by the upper end portion of an annular piston 35 the top face of which is exposed to the pressure of fluid at that location within the mandrel 11. The lower portion of the annular piston 35 is slidably received within a tubular insert 36 which is retained in the bore 32 by means of a screw-threaded retaining collar 37. Stepped configurations of the annular piston 35 and the tubular insert 36 accommodate a compression spring 38 which urges the annular piston 35 towards the position shown in FIGS. 1 and 2. The space accommodating the compression spring 38 is vented by means of openings 39.

The strength of the compression spring 38 is selected with reference to the pressure drop over the length of the annular piston 35 which is attributable to flow resistance through the annular piston 35. Thus, depression of the annular piston 35 can be accomplished by manipulation of the the fluid circulation through the mandrel 11 which circulation is directly under the control of the driller. Thus, the annular piston 35 is responsive to change in fluid circulation through the mandrel 11.

The fluid control means 15 incorporates latching means for enabling sequential operation of the fluid control means by a series of mutually separate fluid circulation changes. The latching means consists of a cam slot 40 formed in the wall of the annular piston 35 and engaged by pins 41 held in the tubular insert 36. The cam slot 40 defines mutually spaced rest points which determine different axial locations of the annular piston 35. Thus, a momentary increase in fluid circulation can shift the annular piston 35 to open, and leave open, the duct 33. Similarly, a further momentary increase in fluid circulation can action the annular piston 35 to reclose the duct 33. In FIG. 2, the bi-stable travel of the annular piston 35 is represented by the dimension B.

Figure 5:
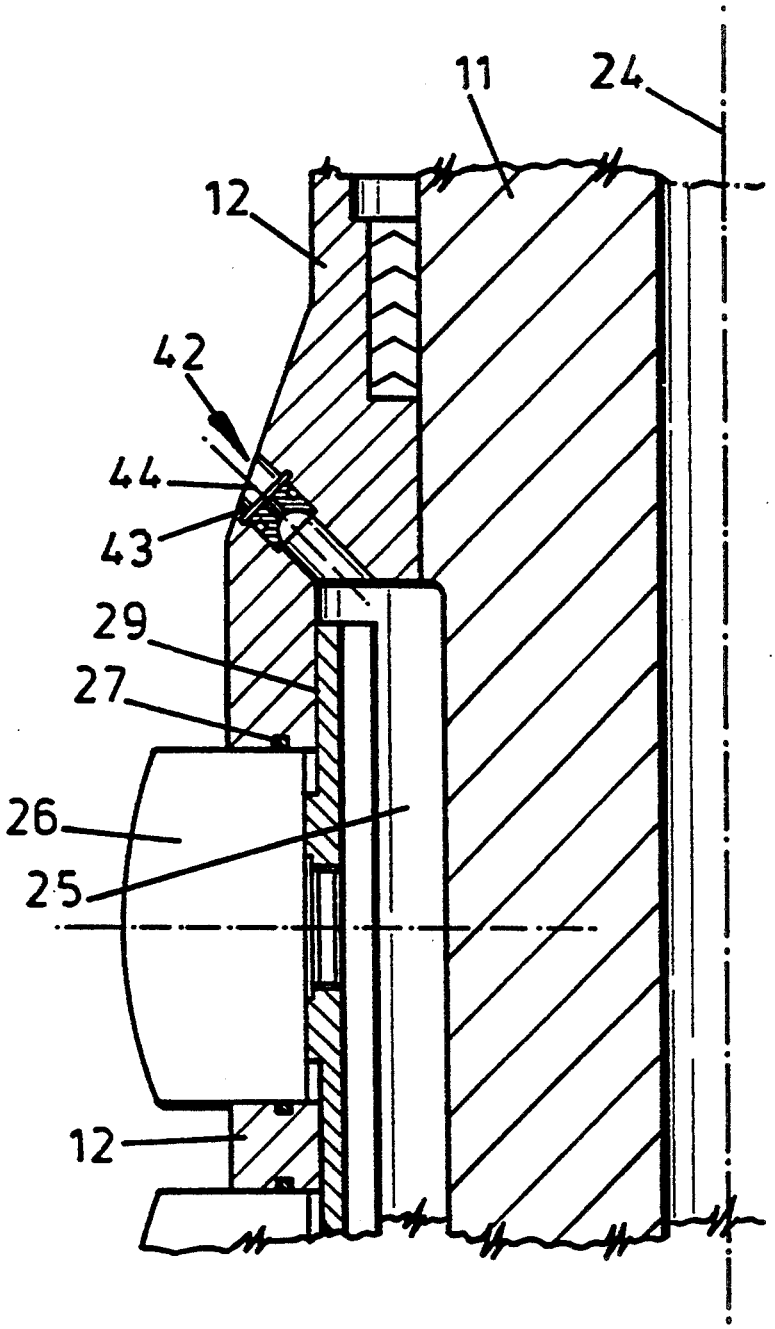
FIG. 5 is a sectional elevation corresponding with another part of FIG. 1 and to a larger scale than FIG. 1.

The fluid control means 15 described above is operable for the admission of pressure fluid to the annular chamber 25. However, the expression "fluid control means" in this embodiment, also embraces a fluid escape port 42 (see FIG. 5) between the annular chamber 25 and a location outside of the sleeve 12 adjacent the top end portion thereof. The fluid escape port 42 incorporates an insert 43 provided with a metering orifice 44 the size of which is determined with reference to a specified pressure drop in circulating fluid during normal drilling as explained further herebelow.

It will be appreciated that the diameter and length dimensions of the open bore through the annular piston 35 together with the strength and rate of the spring 38 will be calculated with reference to the viscosity of the drilling fluid and the circulation rates and fluid pressures to be used. Typical values for the parameters involved are as follows in Table 1.

TABLE 1

| PARAMETER | VALVE |
|---|---|
| Drilling mud weight | 12 pounds/gallon |
| Circulation rate | 700 gallons/minute |
| Fluid Pressure in tool | 700 pounds/sq. in. |
| Bore area of piston 35 | 2.4 sq. in. |
| Pressure drop over piston 35 | 94 pounds/sq. in. |
| Force of spring 38 (relatively low spring rate) | 240 pounds |
| Increase in circulation rate to shift piston 35 against spring 38 | 50 gallons/minute (Increased rate = 750 gallons/min) |
| Cross-sectional area of metering orifice 44. | 0.077 sq. ins. |
| Specified pressure drop | 250 pounds/sq. in. |

In FIG. 2, the cutting diameter of a drill bit is represented by the circle 45; and it will be seen that this provides a hole annulus clear of the sleeve 12 by the dimension C in FIG. 2.

Typical operation of the downhole tool to effect a direction change is as follows. With the plungers 26 in their retracted condition and the sleeve 12 rotationally locked to the mandrel 11, the tool is run in the hole to total depth with normal fluid circulation. At the point of total depth (the point at which the drillbit is at the bottom of the hole) drilling operation is stopped by ceasing both rotation of the drillstring and fluid circulation. Using a conventional survey instrument (not shown) located in the drillstring immediately above the steering tool, the sleeve 12 is oriented by rotating the drillstring so that the quadrant containing the plungers 26 is centred on the desired steering line and facing oppositely to the desired steering direction. Then, without rotating the drillstring, fluid circulation is recommenced and taken momentarily to a higher circulation rate in order to action the fluid control means 15 and admit the fluid (with is under considerable pressure) to the annular chamber 25. Subsequent to the momentary increase in fluid circulation rate, the normal fluid pressure acts to extend the plungers 26 and simultaneously to release the locking means 14. A metered escape of the pressure fluid is provided by the escape port 42 and a resultant pressure drop is detected at the surface so that the driller has confirmation that the tool has been activated. The pressure contact of the plungers 26 with the hole wall 28 effectively steers the drillbit in the required direction upon recommencing rotation of the drillstring and applying weight thereto. It will be understood that during this steering, the sleeve 12 remains rotationally stationary.

In order to end the steering manoeuvre, rotation of the drillstring is stopped and the drillbit un-weighted. Then, a momentary increase in fluid circulation actions the fluid control means to close the duct 33. Fluid pressure within the annular chamber 25 drops to a negligible value allowing the plungers 26 to be self-retracted as previously mentioned herein. Simultaneously, the sleeve 12 is re-locked with the mandrel 11 and drilling on the new direction may be carried on. An indication that the tool has been "de-selected" is given at the surface by return of the fluid pressure to normal, that is by removal of the pressure drop set by the escape port 42.

The steering operation of the downhole tool can be carried out at any time during drilling and as often as is required.

I claim:

1. Apparatus for directional drilling comprising:

a mandrel for running in a drillstring and defining a longitudinal mandrel axis;

drillbit means in driving connection with one end of the mandrel for forming a borehole co-axial with the mandrel;

means defining a supply duct extending longitudinally through the mandrel for carrying drilling fluid to the drill bit means;

a sleeve extending over the mandrel and having mutually opposite sleeve end portions journalled on the mandrel to permit independence of rotation between the mandrel and the sleeve about said mandrel axis;

releasable locking means for locking the sleeve to the mandrel rotationally;

release means associated with the releasable locking means and operative in response to the action of fluid under pressure;

a portion of said sleeve intermediate said sleeve end portions defining a tubular wall having a longitudinal axis which extends parallel with and offset from said mandrel axis;

steering means carried by said tubular wall and extendable and retractable laterally thereof with respect to the mandrel axis to and from pressure contact with an intended borehole in response to action of fluid under pressure for steering said drillbit mans when in use;

the steering means being disposed in said tubular wall as viewed in cross-section in a quadrant thereof most distant from the mandrel axis;

means providing fluid communication between said supply duct and said release means and between said supply duct and said steering means; and fluid control means associated with said fluid communication means for diverting drilling fluid from said supply duct to operate the release means and the steering means.

2. Apparatus according to claim 1, wherein said tubular wall is of hollow cylindrical configuration.

3. Apparatus according to claim 1, wherein said tubular wall is provided with means defining a plurality of openings; and said steering means comprises a plurality of plungers fitted in respective ones of said openings.

4. Apparatus according to claim 3, wherein said plurality of openings defines an even number; and said openings and plungers are arranged in two mutually equal rows; said rows being parallel with said mandrel axis.

5. Apparatus according to claim 1, wherein said releasable locking means comprises interengageable locking means for locking the sleeve to the mandrel at a single angular position of the sleeve with respect to the mandrel.

6. Apparatus according to claim 5, wherein the interengageable locking means includes a locking element on the steering means.

7. Apparatus according to claim 1, including means defining a port providing fluid communication between the interior of the sleeve and the intended borehole.

8. Apparatus according to claim 1, wherein said fluid control means comprises means defining a bore constituting an enlargement of a part of said supply duct and coaxial therewith; an annular piston axially slidably received in said bore; and spring means resiliently urging said annular piston towards a first extreme of axial travel in a direction away from the drillbit means.

9. Apparatus according to claim 8 including a bi-stable latch means associated with said annular piston and having a first stable state in which the annular piston is at said a first extreme of axial travel and having a second stable state in which the annular piston is at a second extreme opposite to first extreme of axial travel.

* * * * *